US009487944B2

(12) United States Patent
Ali

(10) Patent No.: US 9,487,944 B2
(45) Date of Patent: Nov. 8, 2016

(54) JACK-UP CONICAL STRUCTURE

(71) Applicant: Muhammad Amzad Ali, San Ramon, CA (US)

(72) Inventor: Muhammad Amzad Ali, San Ramon, CA (US)

( * ) Notice: Subject to any disclaimer, the term of this patent is extended or adjusted under 35 U.S.C. 154(b) by 0 days.

(21) Appl. No.: 14/580,131

(22) Filed: Dec. 22, 2014

(65) Prior Publication Data

US 2016/0177558 A1 Jun. 23, 2016

(51) Int. Cl.

| | |
|---|---|
| ***E21B 17/00*** | (2006.01) |
| ***E04B 1/343*** | (2006.01) |
| ***E21B 15/02*** | (2006.01) |
| ***E04B 1/34*** | (2006.01) |
| ***E04H 5/02*** | (2006.01) |
| ***B66F 11/00*** | (2006.01) |
| ***E21B 17/01*** | (2006.01) |

(52) U.S. Cl.

CPC ..... *E04B 1/34352* (2013.01); *B66F 11/00* (2013.01); *E04B 1/3404* (2013.01); *E04H 5/02* (2013.01); *E21B 15/02* (2013.01); *E21B 17/015* (2013.01); *F05B 2240/9121* (2013.01)

(58) Field of Classification Search

CPC ..... F03D 11/045; F05B 2240/95; F05B 2240/9121; F05B 2240/97; Y02E 10/727; Y02E 10/728; E02D 27/425; E02D 27/42; E02D 27/12; E02D 27/14; E02D 27/16; E02D 27/52; E02D 17/0004; E02D 17/0091; E21B 17/012; E21B 15/02; E04B 1/34352; E04B 1/3404; E04H 5/02; B66F 11/00

USPC ..... 405/195.1, 196, 200, 221, 203, 217

See application file for complete search history.

(56) References Cited

U.S. PATENT DOCUMENTS 2,953,904 A * 9/1960 Christenson ..... E02B 17/021 405/196
3,221,817 A * 12/1965 De Vries ..... E21B 7/128 166/352
3,277,653 A * 10/1966 Foster ..... E02B 17/021 405/200
3,294,051 A * 12/1966 Khelstovsky ..... B63B 35/4413 114/265
3,793,840 A * 2/1974 Mott ..... E02D 27/42 405/211
3,927,535 A * 12/1975 Giblon ..... E02B 17/021 405/203
3,993,273 A * 11/1976 Dade ..... B63B 21/502 248/56
4,037,424 A * 7/1977 Anders ..... B63B 35/4413 114/294
4,314,776 A * 2/1982 Palmer ..... E02B 17/02 405/203
4,395,157 A * 7/1983 Cunningham ..... E21B 43/0122 405/195.1

(Continued)

FOREIGN PATENT DOCUMENTS

DE 3507023 A1 * 8/1986 ..... B63B 22/021
FR 2040599 A5 * 1/1971 ..... B63B 35/4406

(Continued)

*Primary Examiner* — Babajide Demuren

(57) ABSTRACT

A jack-up conical structure having a generally cone shape. The wide base and narrow upper section enhance stability of the structure during floatation, transport, elevation, anchoring, and drilling. The wide base along with a buoyant portion provide a large water line area which enhances stability of the structure during floatation and transit and while sections of the structure elevate and lower. The wide base also has shear resistance portion that prevents lateral sliding, especially in ice infested waters. A central shaft is disposed in a vertical orientation to the structure and facilitates movement throughout. A conical upper portion moves along the central shaft relative to the conical base. A drilling portion moves on racks of grooves inside the central shaft and performs drilling operations. Numerous chambers, cranes, and helipad support drilling and habitation on the structure.

19 Claims, 4 Drawing Sheets

(56) References Cited

U.S. PATENT DOCUMENTS 4,627,767 A * 12/1986 Field ..... E02B 17/0021 114/264
8,801,333 B2 * 8/2014 Noble ..... E02B 1/003 405/196
8,870,497 B2 * 10/2014 Shafer ..... E02B 17/0021 405/196
8,992,126 B2 * 3/2015 Stephens ..... E02B 17/02 405/196
2010/0150663 A1 * 6/2010 Torres Martinez . E02B 17/0021 405/222

FOREIGN PATENT DOCUMENTS

GB 2017794 A * 10/1979 ..... E02B 17/0021
GB 2091317 A * 7/1982 ..... B63B 21/20
JP 61146909 A * 7/1986
JP 02125012 A * 5/1990

* cited by examiner

JACK-UP CONICAL STRUCTURE

CROSS-REFERENCE TO RELATED APPLICATIONS

The present Utility patent application claims priority benefit of the U.S. provisional application for patent Ser. No. 61/964,193 filed 2013 Dec. 27 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to a jack-up drilling structure with a conical base. More particularly, the invention relates to a conical structure having a wide base and a narrow upper section having means for enhancing stability during floatation, transport, elevation, anchoring, and drilling, while multiple drilling related operations are performed simultaneously.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that a jack-up mobile drilling unit is a rig that can be jacked up above the sea using legs that can be lowered, much like jacks. These rigs are typically used in water depths up to 390 feet, although some designs can go to 560 feet depth. They are designed to move from place to place, and then anchor themselves by deploying the legs to the ocean bottom using a rack and pinion gear system on each leg. Of course these types of jack-up rigs cannot be used in ice infested waters, as the floating ice may get entangled in between the legs and jeopardize the stability of the rig.

Structures with conical base are efficient in resisting lateral ice forces; however, examples of some specific conical structures in the prior art showed that these structures have serious stability problems during floatation and transit. Moreover, these structures could not cover a wide range of water depths.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
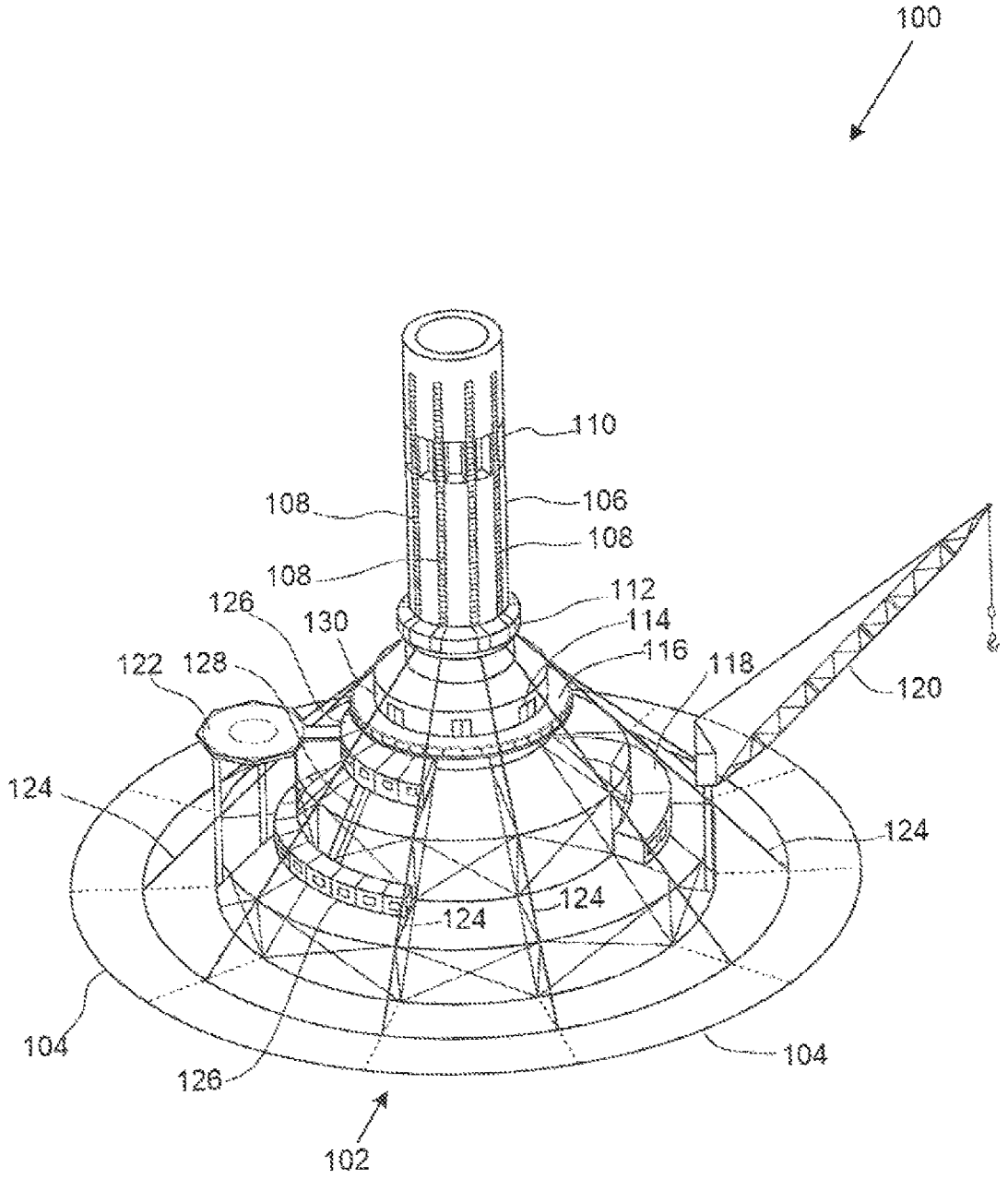
FIG. 1 illustrates a detailed perspective view of an exemplary jack-up drilling structure with a conical base, during transit, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub combination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

In some embodiments, the conical structure may float to a desired area for drilling purposes. The construction of the structure may include tubular members and a lattice shape that reduces weight to enhance the buoyancy of the structure. On arrival at a desired location, the conical base may lower itself onto the sea floor. A buoyant portion may be disposed beneath the conical upper portion to provide greater stability while floating and moving on the water. The buoyant portion may include a pontoon, which provides additional floatation stability during transport and during the time the conical base is lowered to the sea floor.

A central shaft may be disposed in a generally central location to the conical base and the conical upper portion. The conical upper portion including the buoyant portion may move up and down along the length of the central shaft using its own jacking units which operate on a plurality of racks of jacking grooves located on the outer side of the central shaft. In one embodiment, the conical upper section may move high enough above the water line to avoid swells and large waves.

A drill platform provides a surface on the drilling portion for operational aspects of drilling, such as laying down drill pipes, operating valves, and measuring wirelines. Through a plurality of openings in the central shaft the drill platform may be interconnected with at least one working chamber.

While the structure performs drilling functions with the drilling portion, instability to the structure may occur. This may include lateral shifting due to floating ice, and vibrations from the rigors of drilling. Thus, a shear resistant portion beneath the conical base engages the ground surface to help resists lateral sliding along the ground surface, especially in icy and turbulent conditions. Additional components efficacious for drilling and transport may include a drill platform for operating the drilling functions, a circular chamber that interconnects to the drill platform, a helipad, and a crane.

FIG. 1 illustrates a detailed perspective view of an exemplary jack-up drilling structure with a conical base, in accordance with an embodiment of the present invention. In one aspect, a conical structure 100 may have a cone shape with a wide base and a narrow upper section. The upper section of the conical structure is generally narrow and lightweight; also in this embodiment both the drilling portion and the conical upper portion including the buoyant portion can be lowered down during floatation and transport, there will be no top heavy structural problems. The buoyant portion will enable the structure to have a large waterline area; this will enhance stability during floatation and transit.

The wide base may have anti-shear configuration that enhances sliding resistance against lateral ice forces. In this manner, a conical base 102 creates sufficient friction and has strategically positioned gripping members to form a mechanical resistance against lateral sliding. In some embodiments, the structure may also include a conical upper portion 124 that supports numerous functions and components used for drilling. The conical upper portion may have a generally conical shape. The conical upper portion may move up and down along the longitudinal axis of the central shaft on a plurality of racks of outer jacking grooves 108. In one embodiment, the plurality of racks of outer jacking grooves 108 are on the outer wall of a central shaft 106. At least one jacking unit 112 operates on the outer jacking grooves 108 to raise and lower the upper conical portion 124. It is significant to note that only one outer jacking groove 108 may not have sufficient leverage to lift the upper conical portion 124. In one embodiment, the conical upper section may move high enough above the water surface to avoid swells and large waves. Many of the operational components and habitations in the structure are located in the conical upper portion. In some embodiments, the conical upper portion may include a power plant.

In some embodiments, the structure may float to a desired area for drilling purposes. The construction of the conical upper portion may include tubular members and a lattice shape that reduces weight to enhance the buoyancy of the structure. On arrival at a desired location, the conical base may lower itself onto the ground surface beneath the water. A buoyant portion 104 may be disposed beneath the conical upper portion to provide greater stability while floating and moving on the water. The buoyant portion may include a pontoon, which provides additional floatation stability during transport and setup at a location.

Figure 2:
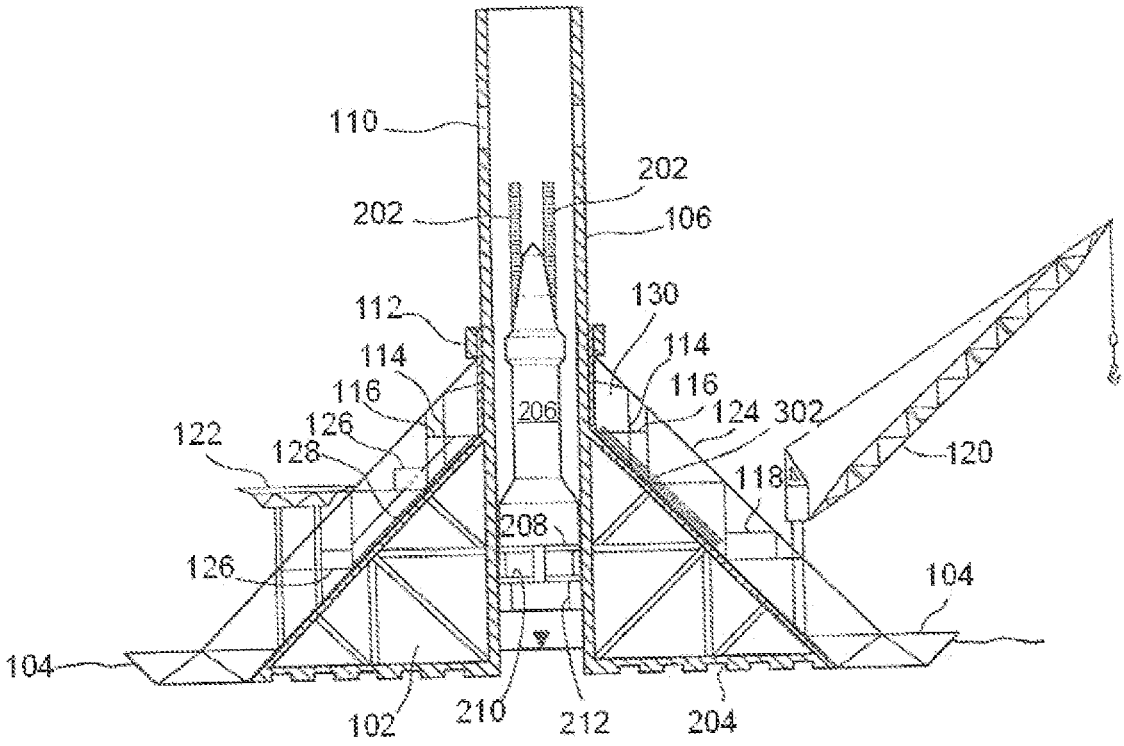
FIG. 2 illustrates a detailed cross-sectional view of an exemplary jack-up drilling structure with a conical base, during transit, in accordance with an embodiment of the present invention.

FIG. 2 illustrates a detailed cross-sectional view of an exemplary jack-up structure with conical base during transit, in accordance with an embodiment of the present invention. A central shaft 106 may be disposed in a generally central location to the conical base and the conical upper portion. The drilling portion may position itself inside the central shaft. A plurality of jacking units 212 may move along a plurality of racks of inner jacking grooves 202 located on the inner side of the central shaft to elevate and lower the drilling portion. In this manner, the drilling portion is controllably displaced relative to the conical base, i.e., raised and lowered as needed.

A drill platform provides a surface on the drilling portion for operational aspects of drilling, such as laying drill pipes, operating valves, and measuring wireline. In some embodiments, once the structure is set up at a location for drilling, escalator 128 may enable automated access to the drilling portion and among the various chambers, quarters, and platforms. The drill platform may be interconnected with a plurality of chambers, including, without limitation, tool storage sheds, sleeping chambers, kitchens, and meeting rooms.

In some embodiments, the structure of the invention not only provides functional aspects for floatation and drilling, but also provides at least one working chamber 130 and a plurality of living quarters 126. In one embodiment, the working chamber 130 is built around the central shaft 106 making it a donut shaped room. After the structure is set up at a location, the floor of the working chamber 130 will be at the same level as the floor of the drilling platform 208. Therefore, more floor area will be available to the drilling crew for drilling operation. Also a patio area 116 and a consumable area 118 can be utilized to receive consumables and other supplies for drilling operation. The structure may include a drill platform 208 for operating the drilling functions, a circular chamber 130 that interconnects to the drill platform, a helipad 122, and a crane 120. A plurality of doors 114 may provide interconnection between the circular chamber 130 and the patio area 116.

For example, a patio area 116 may be used to observe icebergs and general weather conditions from the conical upper section. Doors 114 may interconnect the patio area with the working chamber 130. In another example, a plurality of openings 110 around the central shaft provide access to the drill platform from the working chamber. The patio area 116 around the working chamber 130 may be used to receive consumables through the crane.

In one aspect, while the structure performs drilling functions with the drilling portion, instability to the structure may occur. This may include movements due to lateral ice forces, and vibrations from the rigors of drilling. Thus, a shear resistant portion 204 beneath the conical base engages the ground surface to help resists lateral sliding along the ground surface.

Additional components necessary for drilling may include a drilling portion 206 for performing the operational aspects of drilling. The drilling portion may position itself inside the central shaft 106 for operating the drilling functions. A lower deck 210 beneath the drill platform 208 may accommodate a power plant, fabrication shop, service systems, mud treatment, and some other needed facilities.

Figure 3:
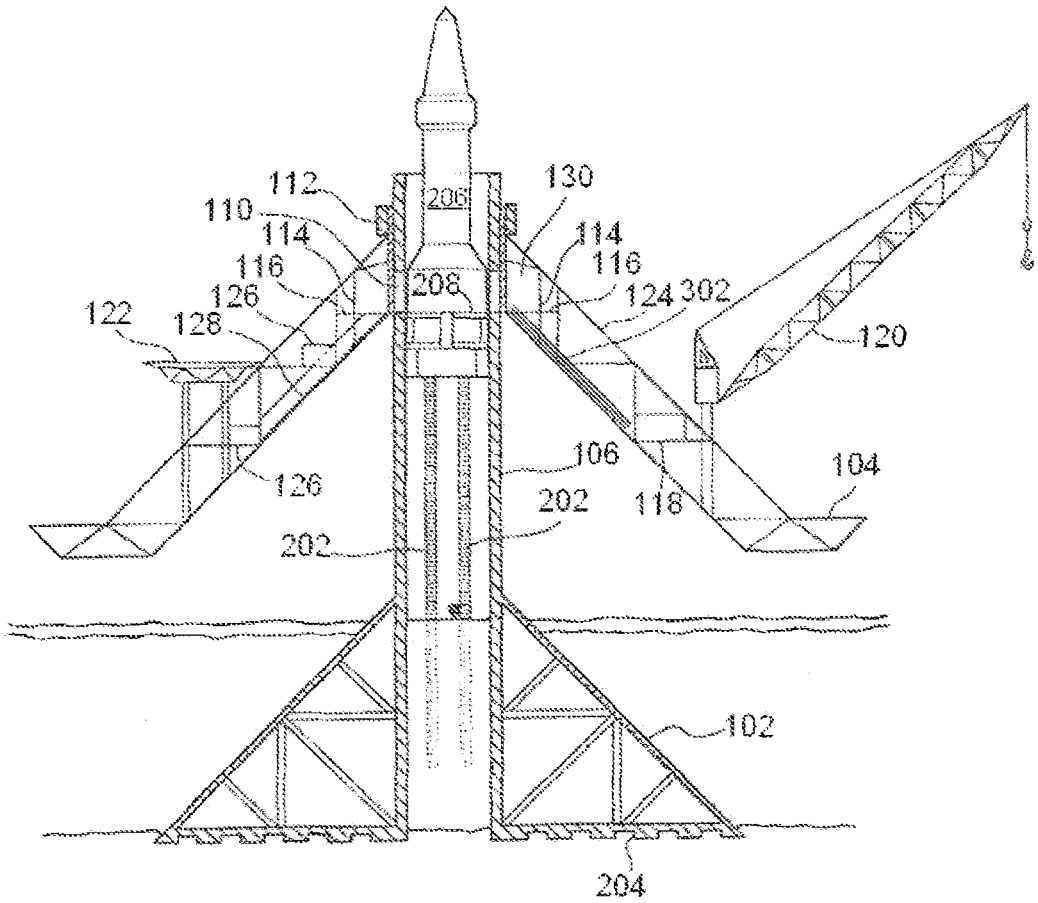
FIG. 3 illustrates a detailed cross-sectional view of an exemplary jack-up drilling structure with the exemplary conical base lowered to the sea floor, while the drilling rig and the conical superstructure jacked up to desired levels, in accordance with an embodiment of the present invention.

FIG. 3 illustrates a detailed cross-sectional view of an exemplary jack-up structure with its conical base lowered for anchoring to the ground surface, in accordance with an embodiment of the present invention. In one aspect, the conical base of the structure anchors to the ground surface, which may include the ocean floor. Once the structure arrives at a location to drill, the main drilling portion 206 may be jacked up to a level little above the conical base by using jacking units 212. The conical base along with the central shaft may then be lowered to sit on the ocean floor. During the time the conical base may be lowered down, the skeletal conical upper portion 124 will be supported by the buoyant portion 104, i.e., pontoon.

After the conical base properly sits on the ocean floor, the conical upper portion may be jacked up using jacking units 112, to a level such that the floor of the working chamber flushes with the sills of the openings 110 in the central shaft. Finally, the drilling portion may be jacked up again to its final level so that the main drill platform flushes with the floor of the working chamber. The structure is now ready for the drilling operation to start as shown in FIG. 3. In one embodiment, during drilling operation, the drilling portion 206 may pull pipe segments from a pipe rack 302 through an opening in the floor of the working chamber. After completion of drilling, the drilling portion may return some pipe segments to pipe rack 302 using the same opening in the floor of the working chamber.

Figure 4:
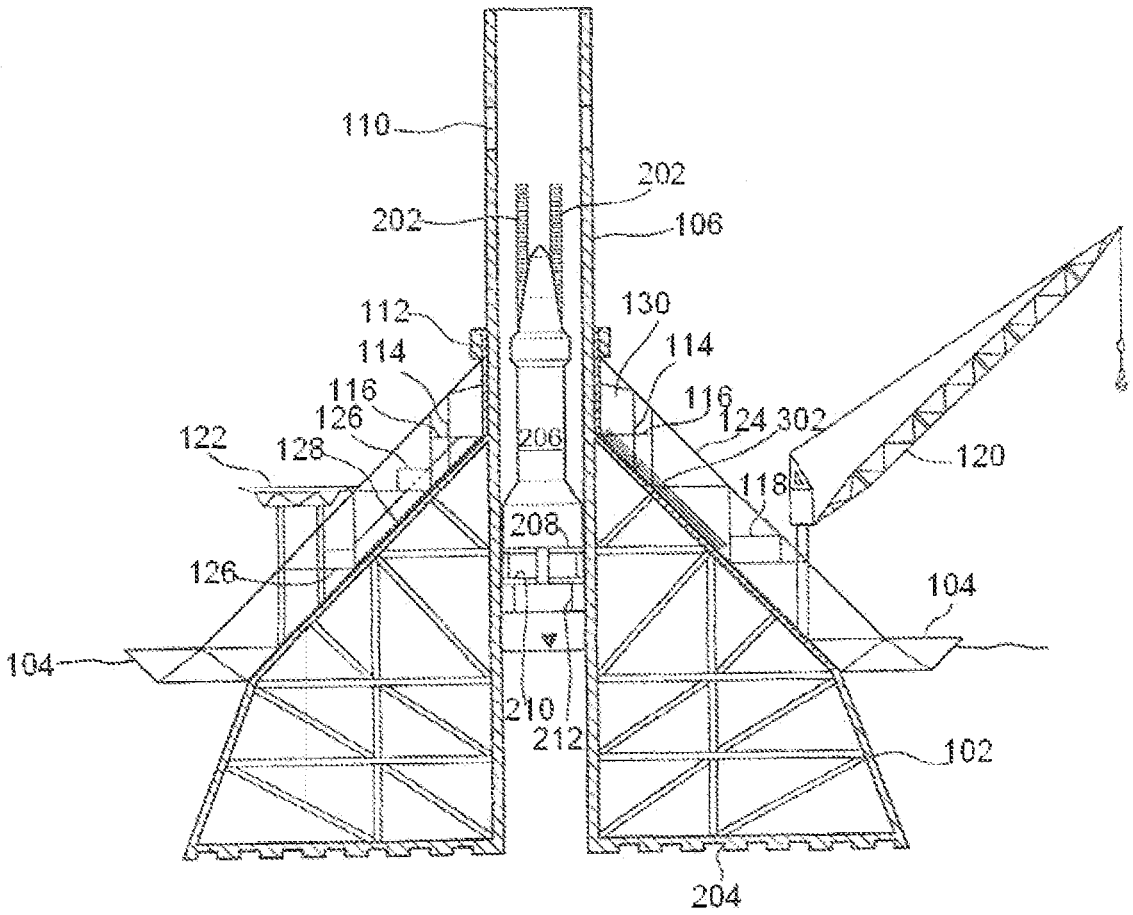
FIG. 4 illustrates a detailed cross-sectional view of an exemplary jack-up drilling structure with a modified conical base, during transit, in accordance with an embodiment of the present invention.

FIG. 4 illustrates a detailed cross-sectional view of an exemplary jack-up structure with an extended conical or semi conical base. This embodiment relates to adaptability of the structure of this invention in relatively deeper waters. Depending on the design, if the embodiment shown in FIGS. 2 & 3 covers a water depth range from 20 feet to 150 feet, the embodiment shown here may cover a water depth range from 150 feet to 250 feet or more, depending on the specific needs of the operator.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a structure that utilizes a generally conical base for enhanced stability during floatation and anchoring according to the present invention will be apparent to those skilled in the art. Various aspects of the invention have been described above by way of illustration, and the specific embodiments disclosed are not intended to limit the invention to the particular forms disclosed. The particular implementation of the structure that utilizes a generally wide base for enhanced stability during floatation and anchoring may vary depending upon the particular context or application. By way of example, and not limitation, conical structure that utilizes a generally wide base for enhanced stability during floatation and anchoring described in the foregoing were principally directed to a drill rig having a conical shape that has a conical base with a large water line area for stable floating in turbulence. The invention is to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A structure comprising:

a central shaft, said central shaft being disposed in a substantially vertical orientation;

a conical base, said conical base comprising a generally conical shape, said conical base further comprising a shear resistance portion, said shear resistance portion being configured to help increase the resistance of said structure against lateral displacement;

a conical upper portion, said conical upper portion comprising a generally conical shape, said conical upper portion being configured for displacement along the longitudinal axis of said central shaft relative to said conical base, said conical upper portion further comprising a buoyant portion, said buoyant portion being configured to help stabilize said structure during floatation;

an outer jacking portion, said outer jacking portion being configured to displace said conical upper portion;

a drilling portion, said drilling portion being configured for displacement along said longitudinal axis of said central shaft relative to said conical base and relative to said conical upper portion, said drilling portion further being configured to perform substantially drilling operations beneath said structure while said structure anchors; and an inner jacking portion, said inner jacking portion being configured to displace said drilling portion.

2. The structure of claim 1, in which said central shaft comprises a plurality of racks of inner jacking grooves disposed in a substantially vertical orientation on an inner wall of said central shaft.

3. The structure of claim 2, wherein said shear resistance portion comprises uneven edges, said uneven edges being configured to grip a ground surface.

4. The structure of claim 3, wherein said conical upper portion is disposed on an outer area of said central shaft.

5. The structure of claim 4, wherein said outer jacking portion is configured to displace said conical upper portion along said central shaft.

6. The structure of claim 5, wherein said outer jacking portion is configured to engage with a plurality of racks of jacking grooves, said plurality of racks of jacking grooves being arranged on said outer wall and along said longitudinal axis of the said central shaft.

7. The structure of claim 6, in which said conical upper portion comprises at least one crane, a power plant, and a helipad.

8. The structure of claim 7, wherein said crane is configured to carry supplies to at least one consumable area, said crane further being configured to deliver consumables and other supplies to a patio area in proximity to at least one working chamber.

9. The Structure of claim 8, in which said conical upper portion comprises at least one escalator and/or at least one elevator.

10. The structure of claim 9, in which said conical upper portion comprises said at least one working chamber and a plurality of living quarters.

11. The structure of claim 10, in which said conical upper portion comprises a plurality of doors and a plurality of corridors for interconnecting said at least one working chamber, said plurality of living quarters, said consumable area, and said power plant.

12. The structure of claim 11, in which said conical upper portion comprises a patio area, said patio area disposed to interconnect with said at least one working chamber through said plurality of doors.

13. The structure of claim 12, in which said buoyant portion comprise a generally circular pontoon.

14. The structure of claim 13, wherein said drilling portion is disposed proximal to said inner wall of said central shaft.

15. The structure of claim 14, in which said conical upper portion comprises a pipe rack, said pipe rack being configured to contain a plurality of pipes.

16. The structure of claim 15, wherein said inner jacking portion is configured to displace said drilling portion along said central shaft.

17. The structure of claim 16, wherein said inner jacking portion is configured to engage with a plurality of racks of inner jacking grooves arranged on said inner wall and along said longitudinal axis of said central shaft.

18. The structure of claim 17, in which said drilling portion comprises a drill Platform and a lower deck.

19. A structure consisting of:

a central shaft, said central shaft being disposed in a substantially vertical orientation, said central shaft comprising a plurality of racks of inner jacking grooves on an inner wall and a plurality of outer jacking grooves on an outer wall of said central shaft; said central shaft comprising at least one opening, said opening being configured to interconnect a drilling floor and at least one working chamber;

a conical base, said conical base comprising a generally conical shape, said conical base further comprising a shear resistance portion, said shear resistance portion being configured to help anchor said structure, said shear resistance portion comprising uneven edges, said uneven edges being configured to grip on a ground surface;

a conical upper portion, said conical upper portion comprising a generally conical shape, said conical upper portion being disposed on an outer area of said central shaft, said conical upper portion being configured for displacement along the longitudinal axis of said central shaft relative to said conical base, said conical upper portion further comprising a buoyant portion, said buoyant portion being configured to help stabilize said structure while said structure floats, said conical upper portion further comprising at least one power plant, a crane, and a helipad, said crane being configured to carry supplies to at least one consumable area and to a patio area around at least one working chamber, said conical upper portion further comprising at least one escalator and/or at least one elevator, said conical upper portion further comprising at least one working chamber and a plurality of living quarters, said conical upper portion further comprising a plurality of doors and a plurality of corridors for interconnecting said at least one working chamber, said plurality of living quarters, said consumable area, and said power plant, said conical upper portion further comprising at least one patio area, said at least one patio area disposed to interconnect with said at least one working chamber; and a drilling portion, said drilling portion being disposed in an inner area of said central shaft, said drilling portion being configured for displacement along said longitudinal axis of said central shaft relative to said conical base and said conical upper portion, said drilling portion further being configured to perform substantially drilling operations beneath said structure while said structure anchors, said drilling portion comprising an inner jacking portion, said inner jacking portion being configured to displace said drilling portion along said longitudinal axis of said central shaft, said drilling portion further comprising a drill platform and a lower deck, said drill platform comprising drilling equipment and accessories needed to perform substantially drilling operations beneath said structure while said structure anchors, said lower deck comprising a power plant, a fabrication shop, mud treatment, and some other needed facilities.

* * * * *